US006305928B1

(12) United States Patent
Novak

(10) Patent No.: US 6,305,928 B1
(45) Date of Patent: Oct. 23, 2001

(54) CANDLE SNUFFING DEVICE

(76) Inventor: Josephine M. Novak, 1103-A Talbots La., Elk Grove Village, IL (US) 60007

( * ) Notice: Subject to any disclaimer, the term of this patent is extended or adjusted under 35 U.S.C. 154(b) by 0 days.

(21) Appl. No.: 09/714,908

(22) Filed: Nov. 17, 2000

(51) Int. Cl.[7] ..... F23Q 25/00
(52) U.S. Cl. ..... 431/145; 431/144; D29/127
(58) Field of Search ..... 431/144–152, 431/33, 344, 345; D29/127; D7/686; 169/46, 54

(56) References Cited

U.S. PATENT DOCUMENTS

| | | | | |
|---|---|---|---|---|
| D. 157,245 | | 2/1950 | Egle . | |
| 717,186 | * | 12/1902 | Galipeau | 431/145 |
| 1,936,691 | | 11/1933 | Soss . | |
| 2,785,556 | | 3/1957 | Smith . | |
| 3,775,037 | | 11/1973 | Sande . | |
| 3,985,492 | | 10/1976 | Nunemaker . | |
| 5,282,737 | | 2/1994 | Ray . | |
| 5,344,309 | * | 9/1994 | Phare | 431/145 |

FOREIGN PATENT DOCUMENTS

| | | | | |
|---|---|---|---|---|
| 2349686 | * | 8/2000 | (GB) | 431/144 |

* cited by examiner

*Primary Examiner*—James C. Yeung

(57) ABSTRACT

A candle snuffing device for snuffing out a candle without producing smoke. The candle snuffing device includes a housing. The housing has a front wall, a back wall and a peripheral wall integrally coupled to and extending between the front and back walls. A first tubular member is elongate and has a first end and a second end. The first tubular member is securely coupled to the housing such that the first end of the first tubular member extends into housing. A reservoir for holding a fluid is positioned in the housing. A pumping means for pumping liquid out of the reservoir is fluidly coupled to the reservoir and extends outwardly from the housing through the peripheral wall. A hose member has a first end and a second end. The first end is mechanically coupled to the pumping means. The hose member extending through the reservoir and through the first tubular member. A block member has a front side, a back side, and a perimeter edge extending therebetween. The perimeter edge comprises a first side edge, a second side edge, a third side edge and a fourth side edge, wherein the third edge is positioned opposite of the first edge. The third edge is securely coupled to the second end of the first tubular member. A first bore extends into the first side edge. The hose member extends into the block member and into the first bore.

7 Claims, 5 Drawing Sheets

CANDLE SNUFFING DEVICE

BACKGROUND OF THE INVENTION

1. Field of the Invention

The present invention relates to candle snuffing devices and more particularly pertains to a new candle snuffing device for snuffing out a candle without producing smoke.

2. Description of the Prior Art

The use of candle snuffing devices is known in the prior art. More specifically, candle snuffing(g devices heretofore devised and utilized arc known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,282,737; 3,775,037; 1,936,691; U.S. Pat. Des. No. 157,245; U.S. Pat. Nos. 2,785,556; and 3,985,492.

While these devices fulfill their respective, particular objectives and requirements, the aforementioned patents do not disclose a new candle snuffing device. The inventive device includes a housing. The housing has a front wall, a back wall and a peripheral wall integrally coupled to and extending between the front and back walls. A first tubular member is elongate and has a first end and a second end. The first tubular member is securely coupled to the housing such that the first end of the first tubular member extends into housing. A reservoir for holding a fluid is positioned in the housing. A pumping means for pumping liquid out of the reservoir is fluidly coupled to the reservoir- and extends outwardly from the housing through the peripheral wall. A hose member has a first end and a second end. The first end is mechanically coupled to the pumping means. The hose member extending through the reservoir and through the first tubular member. A block member has a front side, a back side, and a perimeter edge extending therebetween. The perimeter edge comprises a first side edge, a second side edge, a third side edge and a fourth side edge, wherein the third edge is positioned opposite of the first edge. The third edge is securely coupled to the second end of the first tubular member. A first bore extends into the first side edge. The hose member extends into the block member and into the first bore.

In these respects, the candle snuffing device according to the present invention substantially departs from the conventional concepts and designs of the prior art, and in so doing provides an apparatus primarily developed for the purpose of snuffing out a candle without producing smoke.

SUMMARY OF THE INVENTION

In view of the foregoing disadvantages inherent in the known types of candle snuffing devices now present in the prior art, the present invention provides a new candle snuffing device construction wherein the same can be utilized for snuffing out a candle without producing smoke.

The general purpose of the present invention, which will be described subsequently in greater detail, is to provide a new candle snuffing device apparatus and method which has many of the advantages of the candle snuffing devices mentioned heretofore and many novel features that result in a new candle snuffing device which is not anticipated, rendered obvious, suggested, or even implied by any of the prior art candle snuffing devices, either alone or in any combination thereof.

To attain this, the present invention generally comprises a housing. The housing has a front wall, a back wall and a peripheral wall integrally coupled to and extending between the front and back walls. A first tubular member is elongate and has a first end and a second end. The first tubular member is securely coupled to the housing such that the first end of the first tubular member extends into housing. A reservoir for holding a fluid is positioned in the housing. A pumping means for pumping liquid out of the reservoir is fluidly coupled to the reservoir and extends outwardly from the housing through the peripheral wall. A hose member has a first end and a second end. The first end is mechanically coupled to the pumping means. The hose member extending through the reservoir and through the first tubular member. A block member has a front side, a back side, and a perimeter edge extending therebetween. The perimeter edge comprises a first side edge, a second side edge, a third side edge and a fourth side edge, wherein the third edge is positioned opposite of the first edge. The third edge is securely coupled to the second end of the first tubular member. A first bore extends into the first side edge. The hose member extends into the block member and into the first bore.

There has thus been outlined, rather broadly, the more important features of the invention in order that the detailed description thereof that follows may be better understood, and in order that the present contribution to the art may be better appreciated. There are additional features of the invention that will be discarded hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new candle snuffing device apparatus and method which has many of the advantages of the candle snuffing devices mentioned heretofore and many novel features that result in a new candle snuffing device which is not anticipated, rendered obvious, suggested, or even implied by any of the prior art candle snuffing devices, either alone or in any combination thereof.

It is another object of the present invention to provide a new candle snuffing device which may be easily and efficiently manufactured and marketed.

It is a further object of the present invention to provide a new candle snuffing device which is of a durable and reliable construction .

An even further object of the present invention is to provide a new candle snuffing device which is Susceptible of a low cost of manufacture with regard to both materials and labor, and which accordingly is then susceptible of low prices of sale to the consuming public, thereby making such candle snuffing device economically available to the buying public.

Still yet another object of the present invention is to provide a new candle snuffing device which provides in the apparatuses and methods of the prior art some of the advantages thereof, while simultaneously overcoming some of the disadvantages normally associated therewith.

Still another object of the present invention is to provide a new candle snuffing device for snuffing out a candle without producing smoke.

Yet another object of the present invention is to provide a new candle snuffing device which includes a housing. The housing has a front wall, a back wall and a peripheral wall integrally coupled to and extending between the front and back walls. A first tubular member is elongate and has a first end and a second end. The first tubular member is securely coupled to the housing such that the first end of the first tubular member extends into housing. A reservoir for holding a fluid is positioned in the housing. A pumping means for pumping liquid out of the reservoir is fluidly coupled to the reservoir and extends outwardly from the housing, through the peripheral wall. A hose member has a first end and a second end. The first end is mechanically coupled to the pumping means. The hose member extending through the reservoir and through the first tubular member. A block member has a front side, a back side, and a perimeter edge extending therebetween. The perimeter edge comprises a first side edge, a second side edge, a third side edge and a fourth side edge, wherein the third edge is positioned opposite of the first edge. The third edge is securely coupled to the second end of the first tubular member. A first bore extends into the first side edge. The hose member extends into the block member and into the first bore.

Still yet another object of the present invention is to provide a new candle snuffing device that directs fluid onto a wick to put out a flame in a manner which prevents smoke from leaving the wick once the flame is extinguished.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
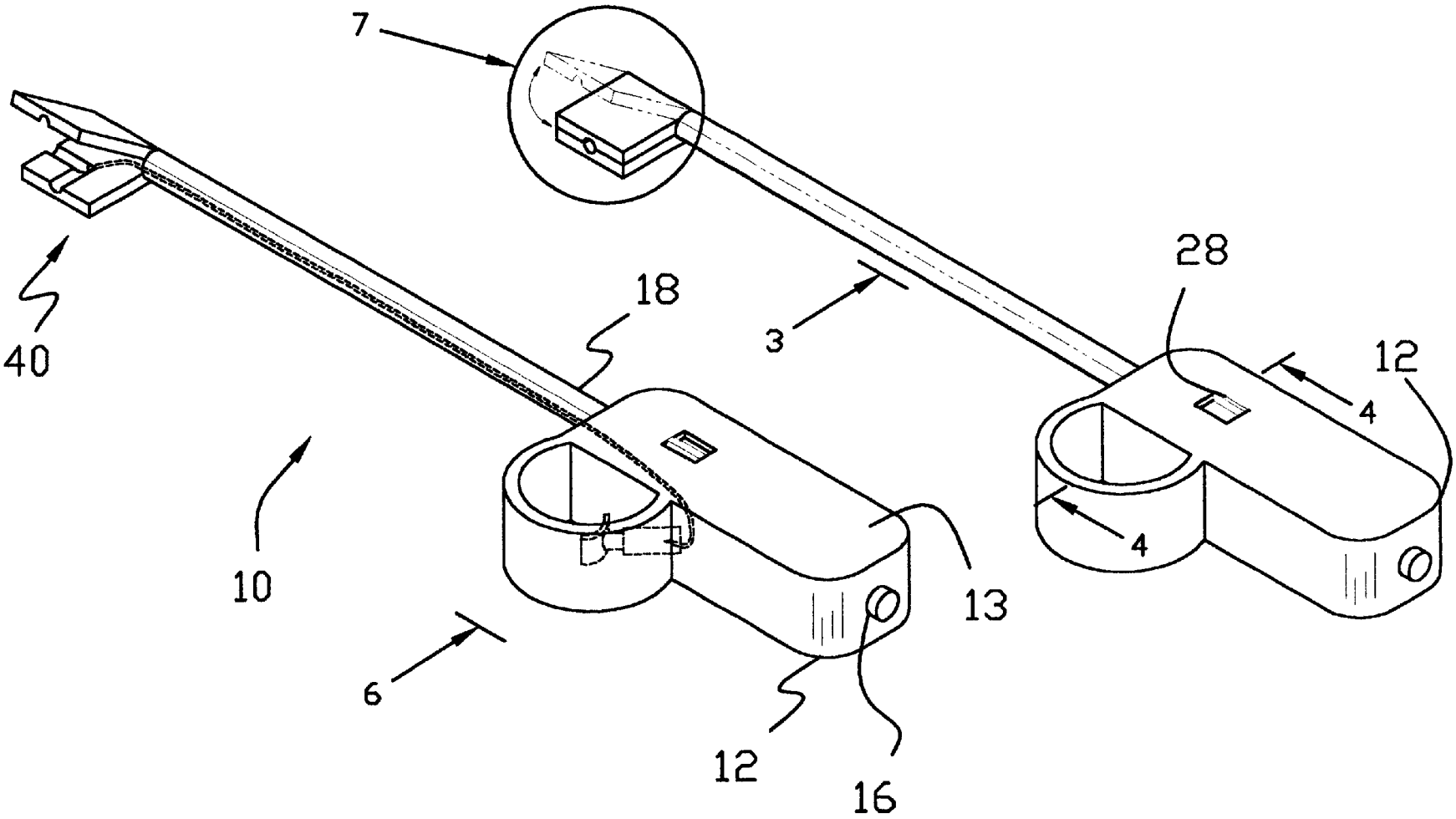
FIG. 1 is a schematic perspective view of a new candle snuffing device according to the present invention.
FIG. 2 is a schematic perspective view of the present invention.
Figure 3:
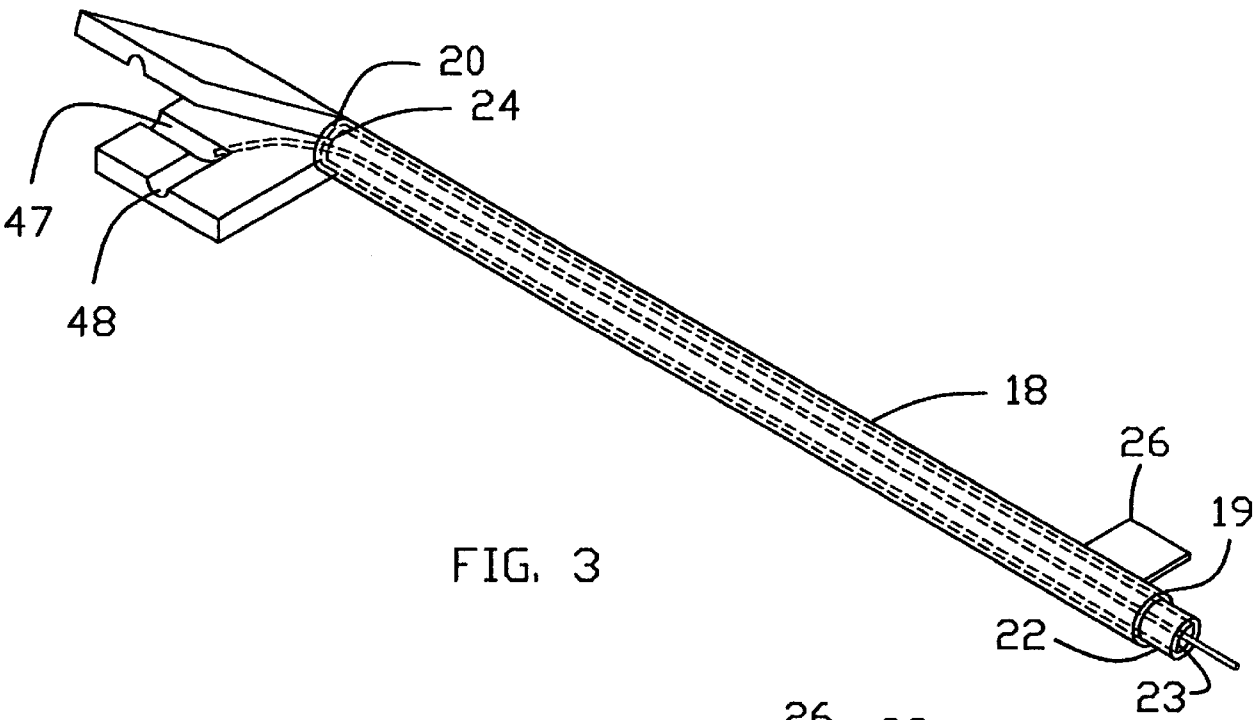
FIG. 3 is a schematic perspective view of the present invention.
Figure 4:
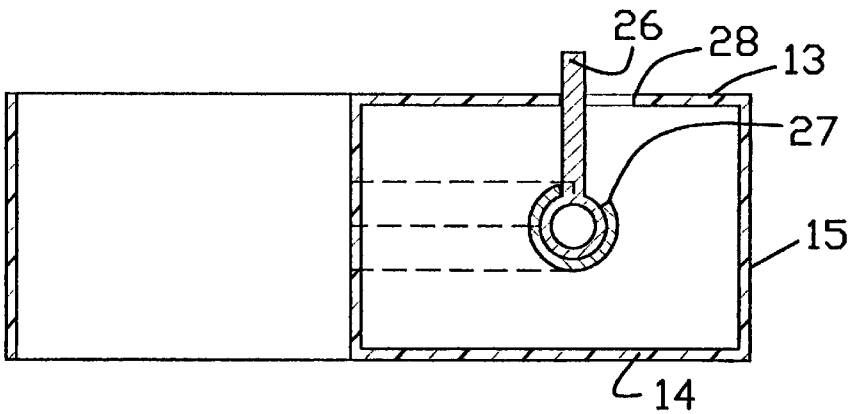
FIG. 4 is a schematic cross-sectional view taken along line 4—4 of the present invention.
Figure 5:
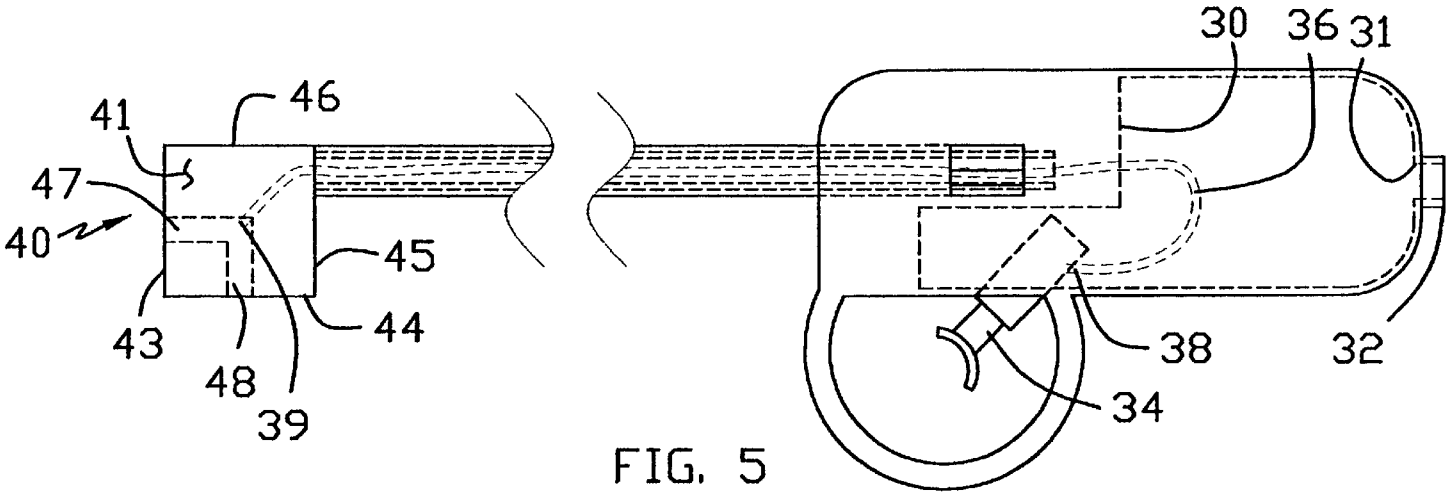
FIG. 5 is a schematic exploded view of the housing and block member of the present invention.
Figure 6:
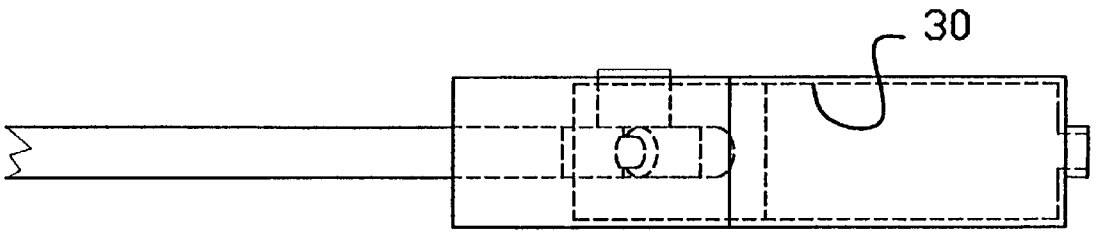
FIG. 6 is a schematic side view of the housing of the present invention.
Figure 7:
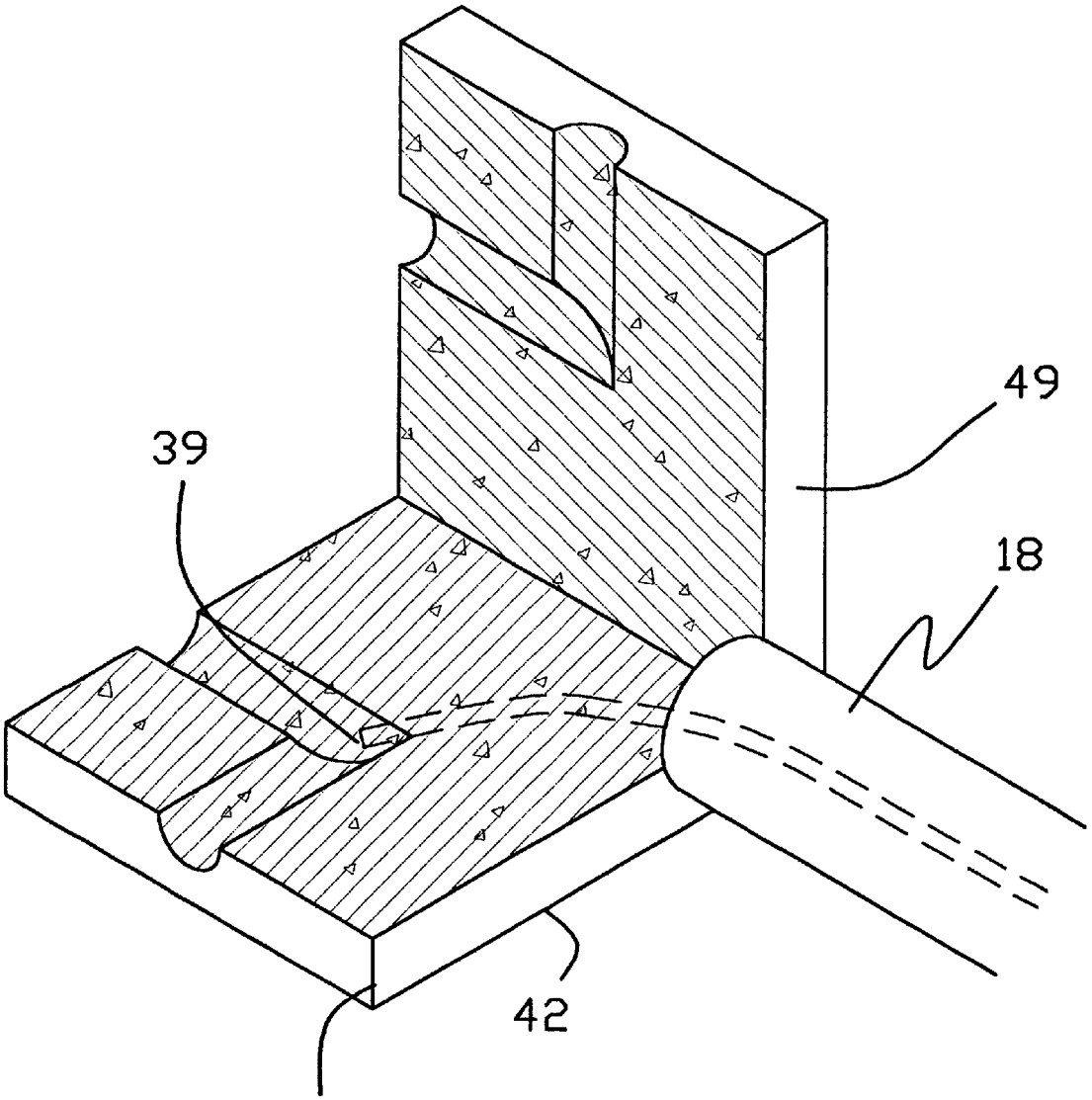
FIG. 7 is a schematic exploded view of the block member of the present invention.
Figure 8:
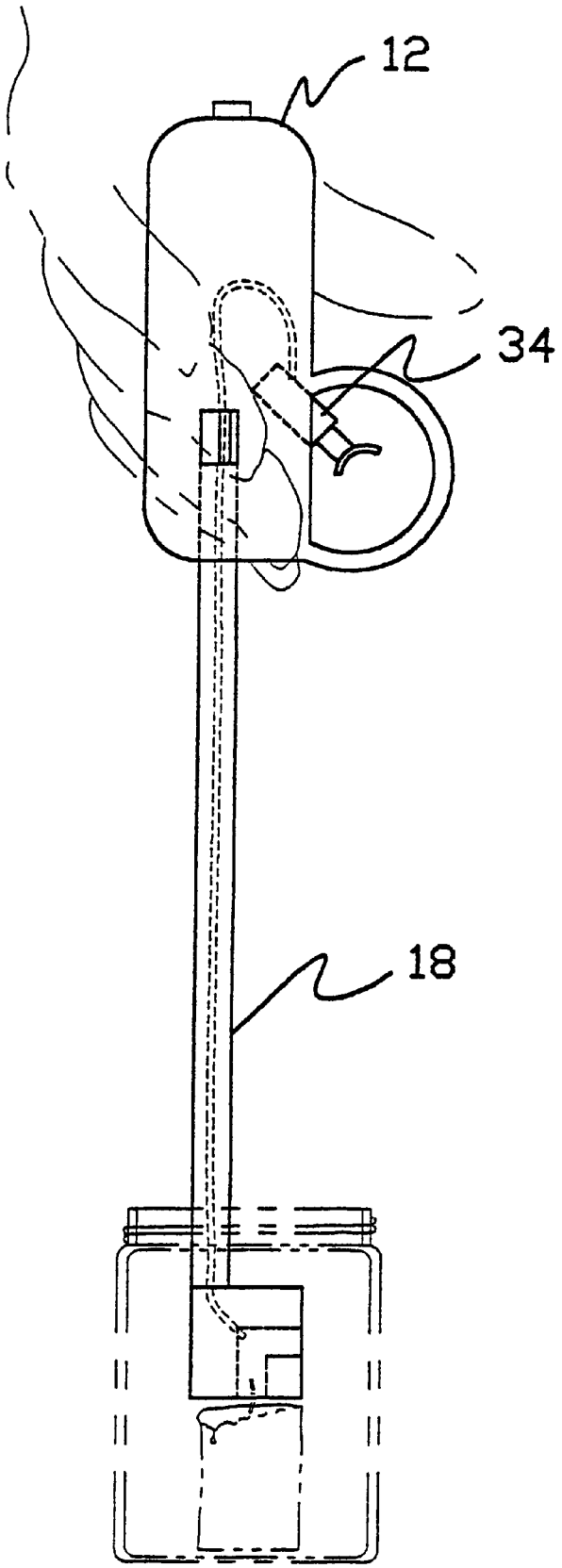
FIG. 8 is a schematic side view of the present invention.

With reference now to the drawings, and in particular to FIGS. 1 through 8 thereof, a new candle snuffing device embodying the principles and concepts of the present invention and generally designated by the reference numeral 10 will be described.

As best illustrated in FIGS. 1 through 8, the candle snuffing device 10 generally includes a housing 12. The housing 12 has a front wall 13, a back wall 14 and a peripheral wall 15 integrally coupled to and extending therebetween the front 13 and back 14 walls. The peripheral wall has a hole 16 therein.

A first tubular member 18 is elongate and has a first end 19 and a second end 20. The first tubular member 18 is securely coupled to the housing 12 such that the first end 19 of the first tubular member extends into the housing 12.

A second tubular member 22 is elongate and has a first end 23 and a second end 24. The second tubular member 22 is rotationally positioned in the first tubular member 18 such that the first 18 and second tubular 22 members are generally coaxial. The second tubular member 22 has a length substantially equal to the first tubular member 18. The second end 24 of the second tubular member 22 is located adjacent to the second end 20 of the first tubular member 18.

A tab 26 is coupled to and extends away from the second tubular member 22. The tab is positioned generally adjacent to the first end 23 of the second tubular member 22. The tab 26 extends through a first slot 27 in the first tubular member 18 and a second slot 28 in the front wall 13 of the housing 12. The tab 26 may be selectively moved such that the second tubular member 22 rotates with respect to the first tubular member 18.

A reservoir 30 for holding a fluid is positioned in the housing 12. The reservoir 30 has an aperture therein. A lip 31 extends away from and is integrally coupled to an edge of the aperture. The lip 31 extends through the opening in the housing. A cap 32 member is adapted for releasably engaging the lip.

A pumping means 34 for pumping liquid out of the reservoir 30 is fluidly coupled to the reservoir 30 and extends outwardly from the housing 12 through the peripheral wall 15. The pumping means 34 is a conventional one as typically found in water guns.

A hose member 36 has a first end 38 and a second end 39. The first end 38 is mechanically coupled to the pumping means 34. The hose member 36 extends into the reservoir 30 and through the second tubular member 22. The second end 39 of the hose member 36 extends outwardly from the second end 39 of the second tubular member 22.

A block member 40 has a front side 41, a back side 42, and a perimeter edge extending therebetween. The perimeter edge comprises a first side edge 43, a second side edge 44, a third side edge 45 and a fourth side edge 46, wherein the third edge 45 is positioned opposite of the first edge 43. A first bore 47 extends into the first side edge 43. A second bore 48 extends into the second side edge 44. The second bore 48 extends into the first bore 47. The hose member 36 extends into the block member 40 such that the second end 39 of the hose is positioned in a juncture of the first and second bores. The block member 40 is divided along a plane orientated generally perpendicular to the front side 41 and extending through the first 47 and second 48 bores such that a first portion 49 and a second portion 50 are defined. The third edge 45 of the first portion 49 is securely attached to the second end 20 of the first tubular member 18. The third edge 45 of the second portion 50 is securely attached to the second end 22 of the second tubular member 24. The second tubular member 24 may be rotated such that the block member 40 is selectively positioned between an open position as shown in FIG. 1 and a closed position as shown in FIG. 2. The block member 40 preferably comprises a generally nonflammable material. The nonflammable material is preferably a concrete or fired clay material.

In use, when the user wishes to put out a candle flame without the wick expelling smoke, the block member 40 is opened so that the wick 60 is positioned in one of the bores 47, 48. The user then actuates, the pumping means 34 so that water in the reservoir 30 may be sent through the hose 36 and into the bore. Which ever bore is used depends on the angle of the wick 60 with relation to the device 10. The reservoir 30 is refilled by removing the cap member 32 and pouring water into the reservoir.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all Suitable modifications and equivalents may be resorted to, falling within the scope of the invention.

I claim:

1. A candle snuffing device, said device comprising:

a housing, said housing having a front wall, a back wall and a peripheral wall integrally coupled to and extending therebetween said front and back walls;

a first tubular member, said first tubular member being elongate and having a first end and a second end, said first tubular member being securely coupled to said housing such that said first end of said first tubular member extends into housing;

a reservoir for holding a fluid, said reservoir being positioned in said housing;

a pumping means for pumping liquid out of said reservoir, said pumping means being fluidly coupled to said reservoir and extending outwardly from said housing through said peripheral wall;

a hose member, said hose member having a first end and a second end, said first end being mechanically coupled to said pumping means, said hose member extending into said reservoir and through said first tubular member; and a block member, said block member having a front side, a back side, and a perimeter edge extending therebetween, said perimeter edge comprising a first side edge, a second side edge, a third side edge and a fourth side edge, said third edge being positioned opposite of said first edge, a first bore extending into said first side edge, said hose member extending into said block member and into said first bore.

2. The candle snuffing device as in claim 1, further comprising:

a second tubular member, said second tubular member being elongate and having a first end and a second end, said second tubular member being rotationally positioned in said first tubular member such that said first and second tubular members are generally coaxial, said second tubular member having a length substantially equal to said first tubular member, said second end of said second tubular member being located adjacent to said second end of said first tubular member; and said block member being divided along a plane orientated generally perpendicular to said front side and extending through said first bore such that a first portion and a second portion are defined, said third edge of said first portion being securely attached to said second end of said first tubular member, said third edge of said second portion being securely attached to said second end of said second tubular member, wherein said second tubular member may be rotated such that said block member is selectively positioned between an open and a closed position.

3. The candle snuffing device as in claim 2, further comprising:

a second bore extending into said second side edge, said second bore extending into said first bore.

4. The candle snuffing device as in claim 1, further comprising:

a second bore extending into said second side edge, said second bore extending into said first bore.

5. The candle snuffing device as in claim 1, further comprising:

said reservoir having an aperture therein, a lip extending away from and being integrally coupled to an edge of said aperture, said lip extending through an opening in said peripheral wall of said housing; and a cap member, said cap member being adapted for releasably engaging said lip.

6. The candle snuffing device as in claim 2, further comprising:

a tab, said tab being coupled to and extending away from said second tubular member, said tab being positioned generally adjacent to said first end of said second tubular member, said tab extending through a first slot in said first tubular member and a second slot in said front wall of said housing, wherein said tab may be selectively moved such that said second tubular member rotates with respect to said first tubular member.

7. A candle snuffing device, said device comprising:

a housing, said housing having a front wall, a back wall and a peripheral wall integrally coupled to and extending therebetween said front and back walls, said peripheral wall having a hole therein;

a first tubular member, said first tubular member being elongate and having a first end and a second end, said first tubular member being securely coupled to said housing such that said first end of said first tubular member extends into said housing;

a second tubular member, said second tubular member being elongate and having a first end and a second end, said second tubular member being rotationally positioned in said first tubular member such that said first and second tubular members are generally coaxial, said second tubular member having a length substantially equal to said first tubular members, said second end of said second tubular member being located adjacent to said second end of said first tubular member;

a tab, said tab being coupled to and extending away from said second tubular member, said tab being positioned generally adjacent to said first end of said second tubular member, said tab extending through a first slot in said first tubular member and a second slot in said front wall of said housing, wherein said tab may be selectively moved such that said second tubular member rotates with respect to said first tubular member;

a reservoir for holding a fluid, said reservoir being positioned in said housing, said reservoir having an aperture therein, a lip extending away from and being integrally coupled to an edge of said aperture, said lip extending through said opening in said housing;

a cap member, said cap member being adapted for releasably engaging said lip;

a pumping means for pumping liquid out of said reservoir, said pumping means being fluidly coupled to said reservoir and extending outwardly from said housing through said peripheral wall;

a hose member, said hose member having a first end and a second end, said first end being mechanically coupled to said pumping means, said hose member extending into said reservoir and through said second tubular member, said second end of said hose member extending outwardly from said second end of said second tubular member;

a block member, said block member having a front side, a back side, and a perimeter edge extending therebetween, said perimeter edge comprising a first side edge, a second side edge, a third side edge and a fourth side edge, said third edge being positioned opposite of said first edge, a first bore extending into said first side edge, a second bore extending into said second side edge, said second bore extending into said first bore, said hose member extending into said block member such that said second end of said hose is positioned in a juncture of said first and second bores, said block member being divided along a plane orientated generally perpendicular to said front side and extending through said first and second bores such that a first portion and a second portion are defined, said third edge of said first portion being securely attached to said second end of said first tubular member, said third edge of said second portion being securely attached to said second end of said second tubular member, wherein said second tubular member may be rotated such that said block member is selectively positioned between an open and a closed position, said block member comprising a nonflammable material.

* * * * *